US006227292B1

(12) United States Patent
Cooper

(10) Patent No.: US 6,227,292 B1
(45) Date of Patent: May 8, 2001

(54) FLEXIBLE SINKER BAR ASSEMBLIES

(76) Inventor: Larry V. Cooper, P.O. Box 16573, Lake Charles, LA (US) 22314

( * ) Notice: Subject to any disclaimer, the term of this patent is extended or adjusted under 35 U.S.C. 154(b) by 0 days.

(21) Appl. No.: 09/421,400

(22) Filed: Oct. 21, 1999

Related U.S. Application Data

(63) Continuation-in-part of application No. PCT/US98/22170, filed on Oct. 21, 1998.

(51) Int. Cl.[7] ..... E21B 31/00

(52) U.S. Cl. ..... 166/241.5; 166/242.2; 405/275

(58) Field of Search ..... 166/241.1, 241.5, 166/242.1, 242.2, 243; 403/275

(56) References Cited

U.S. PATENT DOCUMENTS 3,085,305 * 4/1963 Colombet et al. .
3,100,924 * 8/1963 Trier et al. .
3,716,894 * 2/1973 Kingston et al. .
3,739,457 * 6/1973 Davis .
4,024,913 * 5/1977 Grable ..... 166/72

* cited by examiner

*Primary Examiner*—Roger Schoeppel
(74) *Attorney, Agent, or Firm*—William H. Holt

(57) ABSTRACT

Apparatus for recovering logging tools and the like from a wellbore as part of a drilling operation such as for oil wells, irrigation systems and the like. The apparatus includes the use of a flexible connector member in the form of a flexible wire rope, or strand, or cable, or a series of short, bar-like members having lengths of about a couple of inches, or longer, which may be connected together by, for example, hinge pins, or U-joint connectors, or heavy chain-like links, or short lengths of wire-rope. The flexible connector members are provided with socket members attached with resin or by being swaged or crimped to the flexible member. The apparatus takes the place of the conventional rigid sinker bar assembly that typically may be approximately 20 feet in length and causes safety concerns when used with a top drive housing.

13 Claims, 3 Drawing Sheets

FLEXIBLE SINKER BAR ASSEMBLIES

REFERENCE TO RELATED APPLICATIONS

This invention relates to, and is a Continuation-In-Part (CIP) of, my International Application No. PCT/US98/22170 for which the International Filing Date is Oct. 21, 1998.

BACKGROUND OF THE INVENTION

The inventions relate to apparatus for recovering logging tools from a wellbore and, more particularly, to improved, flexible connectors which may, preferably, be in the form of flexible wire rope sinker bar assemblies to replace the known type of rigid sinker bar. When wireline strip over operations are conducted on drilling rigs that utilize top drive systems, potentially serious problems can be encountered when the conventional rigid type sinker bar assemblies are forced to pass around the top drive housing.

Conventional wireline fishing operations are comprised of a number of conventional steps, including:

1. A T-bar clamp is clamped onto the logging line and hung off at the rotary table of the rig.
2. The wireline above the T-bar clamp is cut, and a connector is attached to the end of the cable sticking out of the top of the T-bar clamp assembly.
3. Normally, a rigid sinker bar assembly is attached to the portion of the logging line that is run up and down in the derrick. The typical sinker bar assembly is approximately 20 feet long, and a connector on the lower end of the sinker bar assembly is compatible with a connector on the logging line hung off in the T-bar clamp.
4. Prior to beginning a strip over operation, the sinker bar connector is made-up to the end connector on the logging line hung off in the T-bar clamp. Using the logging winch, tension is applied to the logging line, and the T-bar clamp assembly is removed.
5. The wireline connector assembly is then lowered and positioned near the top of the box connection of the drill pipe hung off in the rotary table.
6. Using a hang-off plate, the lower part of the connector is hung off on top of the box connection. The lower sinker bar connector is disconnected to allow the sinker bar assembly to be raised to the racking board (monkey board) level in the derrick.
7. A stand of drill pipe is then latched into the elevators at the racking board height in the derrick. The sinker bar on the logging line is guided (stabbed) into the top of the stand of drill pipe by the derrickman. Next, the sinker bar is lowered down and out through the bottom end of a stand of drill pipe at the rig floor.
8. The sinker bar assembly is then reattached to the connector on the logging line hung off in the hang-off clamp at the rig floor.
9. Tension is taken on the logging line, and the hang-off clamp is removed.
10. The lower end of the drill pipe stand is slowly lowered over the wireline sinker bar assembly at the rig floor, and the drill pipe connection is made up.
11. Next, the stand of drill pipe is slowly lowered in the hole, stripping over the logging line and sinker bar assembly. Once the drill pipe is hung off in the rotary table, the wireline stripping operation can be continued in this manner until the logging tool is washed over with the fishing tool assembly.

When this type of wireline strip over operation is conducted on drilling rigs that utilize top drive systems, problems can be encountered with rigid sinker bar assemblies. Problems occur because when the top drive approaches the rig floor and the drill pipe is hung off in the rotary table, the rigid sinker bar exits the drill pipe. At this point in the strip over operation, with tension on the wireline, it is necessary for the sinker bar assembly to pass around the outside of the top drive housing. The rigid sinker bar assembly can be put in an overload situation when the sinker bars are forced to bend around the outside of the top drive body. As a result, the threaded connections can fail and this presents a serious safety hazard to rig personnel and also to the wellbore.

SUMMARY OF THE INVENTION

As a result of these safety concerns, various embodiments of the present invention have been developed in order to alleviate the above described problems by providing a flexible connector, preferably in the form of a flexible, wire rope sinker bar assembly to replace the known type of rigid sinker bar assembly described above and thereby result in a safer and more time-efficient wireline stripping operation. Different sizes and types of flexible sinker bars have been designed for specific drill pipe sizes in order to meet allowable work load ratings.

BRIEF DESCRIPTION OF THE DRAWINGS

FIG. 8 shows a modified form of wireline stripping assembly including another form of flexible sinker bar in the form of a series of short, socket-like members hinged together with short lengths of wire rope which can be secured together by swaging, crimping and the like.

DESCRIPTION OF THE PREFERRED EMBODIMENTS

Figure 1:
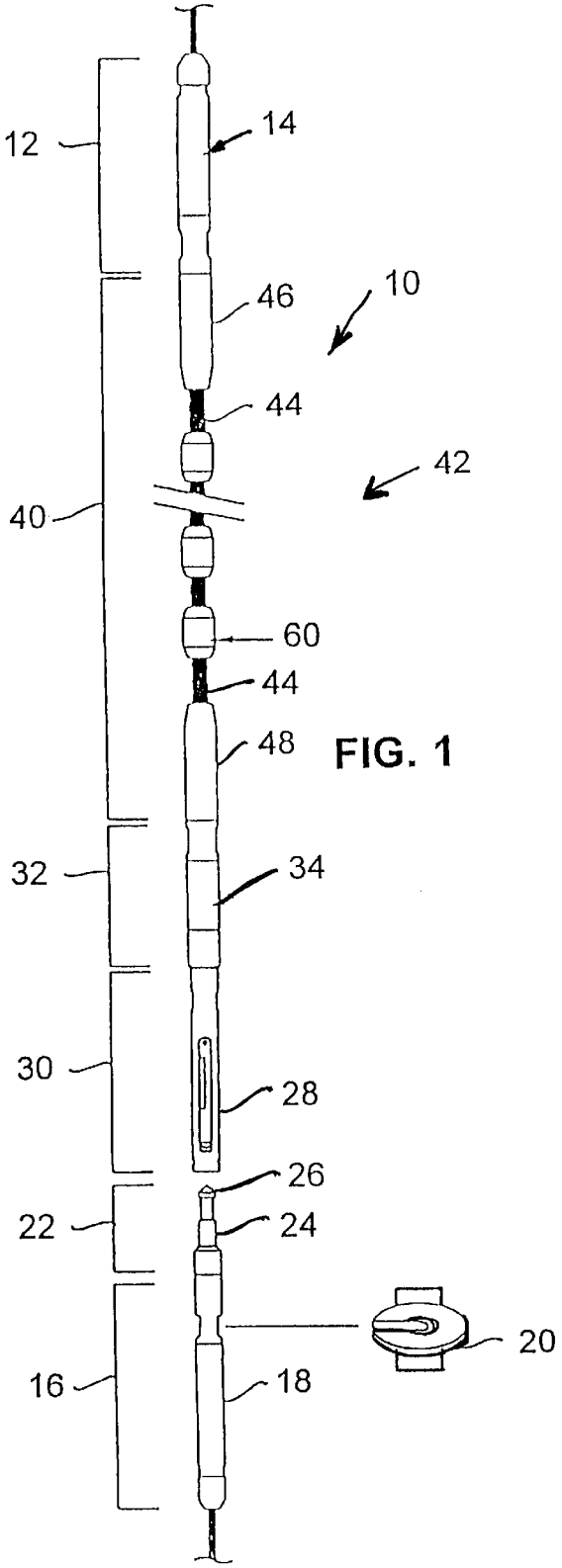
FIG. 1 shows a wireline stripping assembly including a flexible sinker bar in accordance with the invention.

A wireline stripping assembly, generally indicated by the numeral 10, that encompasses a plurality of different sections shown bracketed in FIG. 1 as including an upper rope socket section 12 that provides a slim-line socket 14, and a lower rope socket section 16 that provides a similar slim-line socket 18 which is sized to cooperate with a hang off plate 20.

Located above the lower rope socket section 16 is a spear section 22 comprised of a spear 24 having a tapered head 26 to provide for easy entry into an overlying overshot 28 that forms the overshot section 30. A swivel section 32 includes a rugged dual bearing swivel 34.

Figure 2:
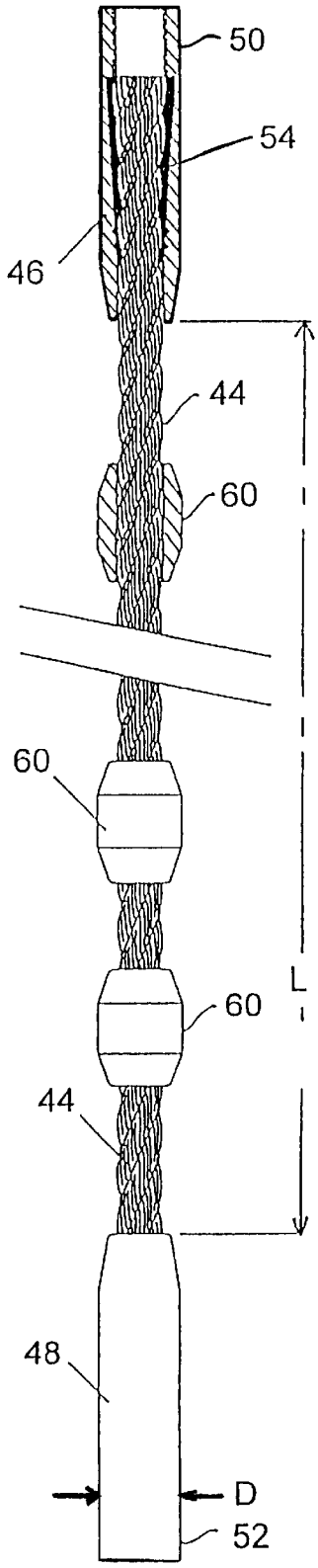
FIG. 2 shows a fragmentary, enlarged portion of FIG. 1, partly in section, illustrating one form of flexible sinker bar in accordance with the invention.

Interposed between swivel section 32 and upper rope socket section 12 is a sinker bar section 40 that encompasses a flexible sinker bar assembly, generally indicated by the numeral 42, the details of which are best shown in enlarged form in FIG. 2. Sinker bar assembly 42 is, in one form of the invention, comprised of a flexible connector in the form of a length of wire rope 44, that is shown in the form of a woven strand or cable, that provides flexibility to the sinker bar assembly 42 and which is fitted at its ends with a respective top socket 46 and a bottom socket 48, each having an internally threaded box connection 50 and 52 for attachment to other wireline hardware, such as swivel 34 and the like. Top socket 46 and bottom socket 48 are similarly constructed and may be installed on the wire rope or cable 44 with a cured resin 54 shown in the sectional view of top socket 46. Resin 54 may be applied in liquid or paste form and is then allowed to cure, i.e., harden to provide a high strength bond between the sockets and wire rope.

Sinker bar assembly 42 is amenable to having additional weight applied thereto through the use of a plurality of dog knots 60, one of which is shown in section in FIG. 2 below top socket 46. The dog knots 60 can be swaged onto the rope or cable 44 while maintaining flexibility of the assembly 42.

The length shown at L in FIG. 2, extending between top socket 46 and bottom socket 48, can be on the order of approximately 20 feet. Sockets 46 and 48 are purposely thin in diameter, shown at D near the bottom of socket 48 to provide clearances for running inside a drill pipe (not shown), but provide heavy duty construction for make-up to wireline retrieval assemblies. Dog knots 60 are added for sinker bar assemblies that may have wire rope 44 between 1⅜ inch and 2 inch; the added weight improves the movement of the assembly through the drill pipe.

Figure 3:
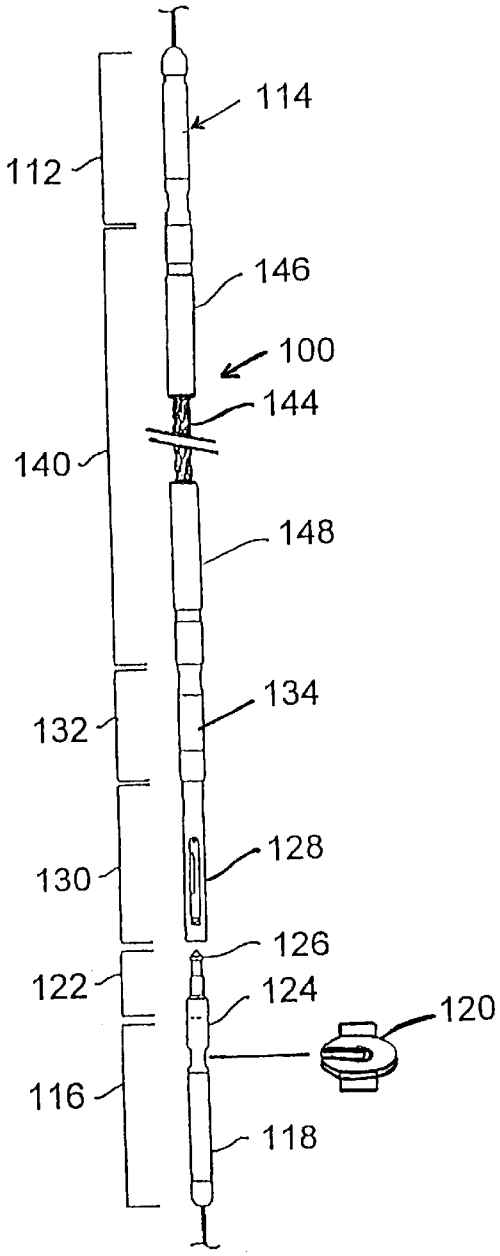
FIG. 3 shows a modified form of wireline stripping assembly including another form of flexible sinker bar in accordance with the invention.
Figure 4:
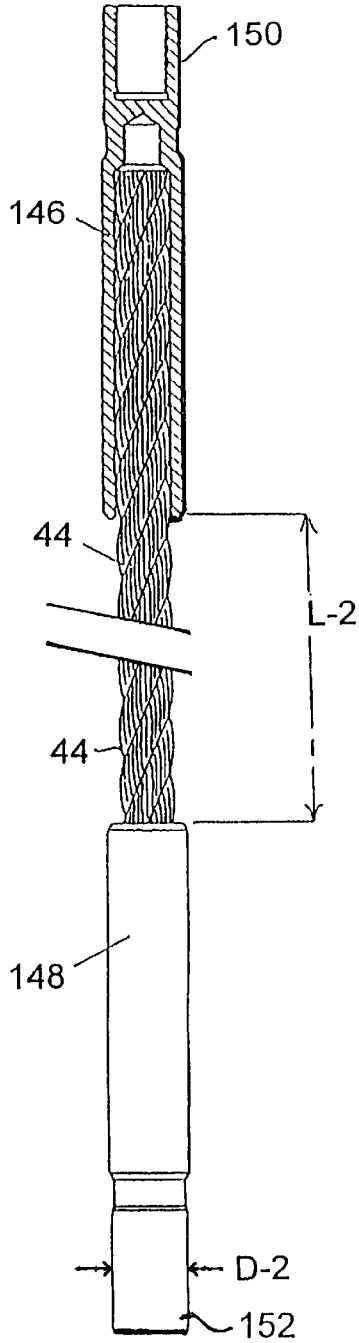
FIG. 4 shows a fragmentary, enlarged portion of FIG. 3, partly in section, illustrating one modified form of flexible sinker bar in accordance with the invention.

FIGS. 3 and 4 illustrate a modification of the apparatus shown in FIGS. 1 and 2. A modified wireline stripping assembly, generally indicated by the numeral 100, that encompasses a plurality of different sections shown bracketed in FIG. 3 as including an upper rope socket section 112 that provides a slim-line socket 114, and a lower rope socket section 116 that provides a similar slim-line socket 118 which is sized to cooperate with a hang off plate 120.

Located above the lower rope socket section 116 is a spear section 122 comprised of a spear 124 having a tapered head 126 to provide for easy entry into an overlying overshot 128 that forms the overshot section 130. A swivel section 132 includes a rugged dual bearing swivel 134.

Interposed between swivel section 132 and upper rope socket section 112 is a sinker bar section 140 that encompasses a flexible sinker bar assembly, generally indicated by the numeral 142, the details of which are best shown in enlarged form in FIG. 4. Sinker bar assembly 142 is, preferably, comprised of a flexible connector in the form of a length of wire rope 144, that is shown in the form of a woven strand or cable, that provides flexibility to the sinker bar assembly 142 and is fitted at its ends with a respective top socket 146 and a bottom socket 148, each preferably having an internally threaded box connection 150 and 152, or other provision, for attachment to other wireline hardware, such as swivel 134 and the like. Top socket 146 and bottom socket 148 are similarly constructed to provide a slim-line socket configured for large diameter wire rope, or the like, and are installed on the wire rope or cable 144, preferably by being swaged thereon, to provide for increased sinker bar weight and assurance against slippage or disconnection from the flexible connector, wire rope, strand or cable.

It is to be noted that the embodiment of FIGS. 3 and 4 does not include the provision of a plurality of dog knots, such as the dog knots 60 shown in FIGS. 1 and 2. There are some operations for which the additional weight of the dog knots is not necessary.

The length shown at L-2 in FIG. 4, extending between top socket 146 and bottom socket 148, can be on the order of approximately 20 feet, more or less. Sockets 146 and 148 are purposely thin in diameter, shown at D-2 near the bottom of socket 148 to provide clearances for running inside a drill pipe (not shown), but provide heavy duty construction for make-up to wireline retrieval assemblies.

The prior art sinker bar has been, typically, a steel bar about 20 feet in length and is, as previously described, a safety hazard. The present invention provides a flexible connector member comprised of the flexible wire rope or cable 44 which may, typically, have a length comparable to the length of prior art, rigid, sinker bars.

FIGS. 5–8 show additional modifications for forming a flexible connector from a series of relatively short segments connected together to be comparable in length and used in place of the heretofore conventional, rigid flexible sinker bars. The respective segments may have a length of several inches, or more, and connecting means are provided to connect adjacent ones of the series of segment along their respective longitudinal axis. The resultant connector member thus includes the desired flexibility incident to the invention.

Figure 5:
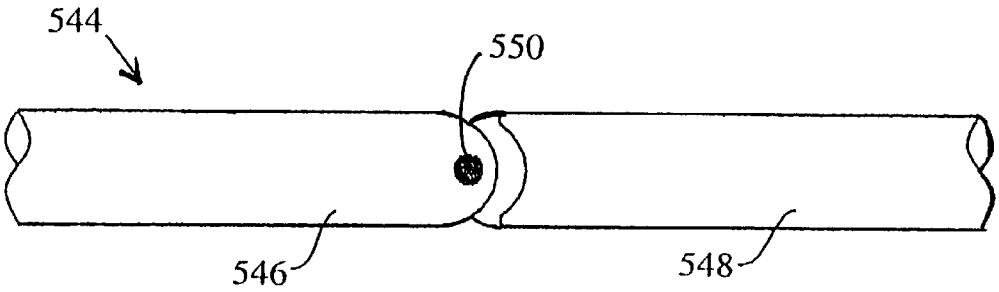
FIG. 5 shows a modified form of wireline stripping assembly including another form of flexible sinker bar in the form of a series of short solid bars hinged together with hinge pins.

FIG. 5 shows a portion of a flexible connector member, generally indicated by the numeral 544, which includes a series of segments 546 and 548 which are fashioned to be hinged together by a hinge pin 550 for providing the desired flexibility.

Figure 6:
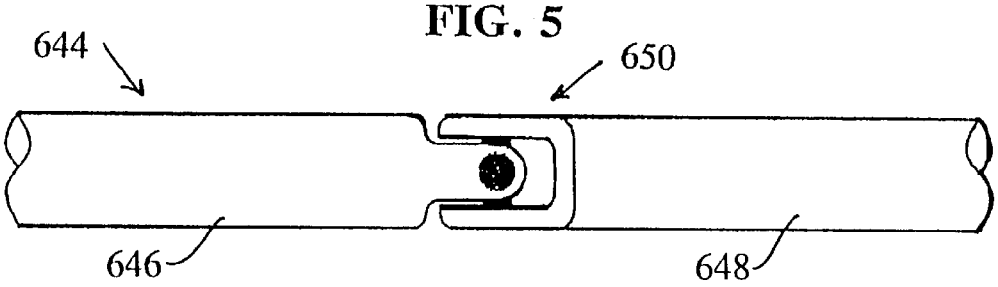
FIG. 6 shows a modified form of wireline stripping assembly including another form of flexible sinker bar in the form of a series of short bars connected together with U-joint hinge members.

FIG. 6 shows a portion of a flexible connector member, generally indicated by the numeral 644, which includes a series of segments 646 and 648 which are fashioned to be hinged together by a U-joint hinge member 650 for providing universal flexibility.

Figure 7:
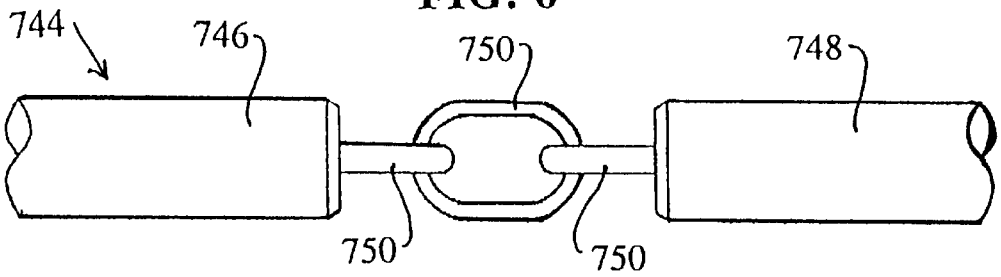
FIG. 7 shows a modified form of wireline stripping assembly including another form of flexible sinker bar in the form of a series of short bars hinged together with heavy chain link members

FIG. 7 shows a portion of a flexible connector member, generally indicated by the numeral 744, which includes a series of segments 746 and 748 which are fashioned to be hinged together by a plurality of chain link hinge members 750.

Figure 8:
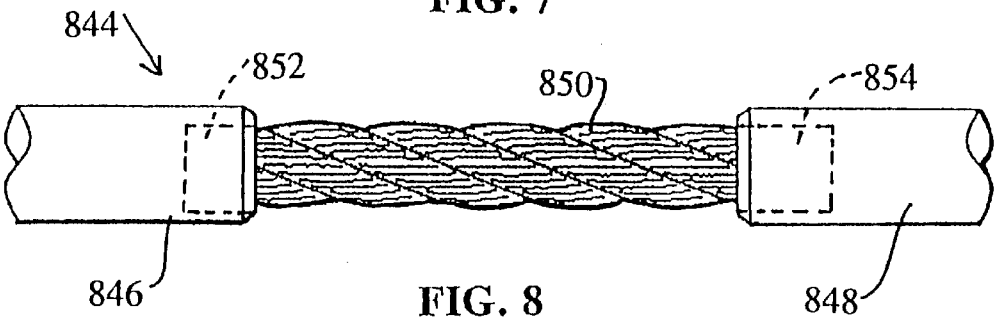

FIG. 8 shows a portion of a flexible connector member, generally indicated by the numeral 844, which includes a series of segments 846 and 848 which are fashioned to be hinged together by a short segment of wire rope 850. Segments 846 and 848 are swaged onto ends of the wire rope 850 and include hollow ends 852 and 854 for receiving an end of wire rope 850.

From the foregoing description, it will be apparent to those skilled in the art that the various forms of the invention provide many advantages and safety features over the known types of rigid sinker bars. While specific showings and descriptions are provided, it is to be understood that differences in size, weight, length, diameters, etc. can be made depending upon variations in any particular wireline operation.

What is claimed is:

1. A flexible sinker bar assembly for use with a top drive housing in wireline stripping operations in connection with a wellbore, said assembly including a flexible connector member having a pair of opposite ends and top and bottom socket members fixedly secured to said ends for adding increased weight thereto, and means for attachment of said socket members to other wireline hardware.

2. A flexible sinker bar assembly as defined in claim 1 including at least one dog knot (60) secured to said flexible member for increasing the weight of said flexible connector member.

3. A flexible sinker bar assembly as defined in claim 1 wherein said socket members are secured to said connector member with cured resin (54).

4. A flexible sinker bar assembly as defined in claim 1 wherein said socket members (146 and 148) are secured to said connector member by being swaged thereto.

5. A flexible sinker bar assembly as defined in claim 1 wherein said flexible connector member is approximately 20 feet in length.

6. A flexible sinker bar assembly as defined in claim 1 wherein said flexible connector member is comprised of heavy metal wirerope.

7. A flexible sinker bar assembly as defined in claim 1 wherein said flexible connector member is comprised of heavy metal flexible cable.

8. A flexible sinker bar assembly as defined in claim 1 wherein said means for attachment of said socket members to other wireline hardware comprises threaded end portions at free ends of said socket members.

9. A flexible sinker bar assembly as defined in claim 1 wherein said flexible connector member is comprised of a series of segments capable of being oriented into axial alignment with each other, and connecting means connecting adjacent ones of said series of segments for providing flexibility to said connector member.

10. A flexible sinker bar assembly as defined in claim 9 wherein said connecting means is comprised of a pinned hinge member for providing flexibility to said connector member.

11. A flexible sinker bar assembly as defined in claim 9 wherein said connecting means is comprised of a U-joint hinge member for providing flexibility to said connector member.

12. A flexible sinker bar assembly as defined in claim 9 wherein said connecting means is comprised of a chain link hinge member for providing flexibility to said connector member.

13. A flexible sinker bar assembly as defined in claim 9 wherein said connecting means is comprised of a wire rope hinge member and said segments are swaged onto said wire rope hinge member for providing flexibility to said connector member.

* * * * *